United States Patent [19]

Henne et al.

[11] Patent Number: 4,709,864

[45] Date of Patent: Dec. 1, 1987

[54] METHOD AND APPARATUS FOR THE CRUSHING OF MATERIAL

[75] Inventors: Heinrich Henne, Ennigerloh; Norbert Patzelt, Beckum; Lutz T. Schneider, Ennigerloh; Osbert Knobloch, Rheda-Wiedenbruck; Manfred Muller, Ennigerloh, all of Fed. Rep. of Germany

[73] Assignee: Krupp Polysius AG, Beckum, Fed. Rep. of Germany

[21] Appl. No.: 880,089

[22] Filed: Jun. 30, 1986

[30] Foreign Application Priority Data

Jul. 19, 1985 [DE] Fed. Rep. of Germany ..... 3525935

[51] Int. Cl.[4] ..... B02C 4/40

[52] U.S. Cl. ..... 241/167; 241/225; 241/230

[58] Field of Search ..... 241/222, 225, 224, 227, 241/230, 231, 63, 64, 246, 247, 30, 166, 167; 100/121; 162/358

[56] References Cited

U.S. PATENT DOCUMENTS

| | | | |
|---|---|---|---|
| 2,340,456 | 2/1944 | Dinley | 241/224 X |
| 3,341,137 | 9/1967 | Rettenmaier | 241/222 |
| 3,484,049 | 12/1969 | Lenz | 241/167 X |
| 3,948,448 | 4/1976 | Wehren et al. | 241/224 X |
| 4,559,106 | 12/1985 | Skytta et al. | 100/121 X |

FOREIGN PATENT DOCUMENTS

| | | | |
|---|---|---|---|
| 1141162 | 12/1962 | Fed. Rep. of Germany | 241/224 |
| 2615415 | 10/1976 | Fed. Rep. of Germany | 100/121 |
| 2708053 | 7/1979 | Fed. Rep. of Germany . | |
| 80490 | 12/1963 | Hungary | 241/222 |
| 6706314 | 11/1967 | Netherlands | 241/225 |
| 2062495 | 5/1981 | United Kingdom | 241/225 |
| 676517 | 7/1979 | U.S.S.R. | 100/121 |

*Primary Examiner*—Mark Rosenbaum
*Attorney, Agent, or Firm*—Learman & McCulloch

[57] ABSTRACT

The invention relates to a method and to apparatus for the crushing of material to be comminuted by means of a material bed roll mill, in which such material is forcibly delivered in a regulable mass flow to the roll gap. In this way even materials which tend to slip on the rolls can be crushed satisfactorily. It is also possible to keep the nature of the product constant over a wide range of variations in the throughput.

4 Claims, 2 Drawing Figures

METHOD AND APPARATUS FOR THE CRUSHING OF MATERIAL

The invention relates to a method and apparatus for the crushing of material to be comminuted by means of two rolls which are pressed against one another at high pressure.

BACKGROUND OF THE INVENTION

The fine and finest crushing of brittle material to be comminuted in the gap between two rolls which are pressed against one another at high pressure is known for example from German Patent Specification No. B-2708053. In that publication the material to be comminuted undergoes material bed crushing in the roll gap. If the material for comminution is delivered with a grain size which is greater than the width of the roll gap, on passing through the roll gap the material first of all undergoes individual grain crushing and immediately thereafter material bed crushing.

In the past the material to be comminuted was generally delivered to the roll gap purely by the effect of gravity via a delivery shaft in which such material reaches a certain filling level.

However, it has now been shown that certain materials tend to slip on the rolls or are not drawn satisfactorily into the roll gap. Such difficulties occur for example in the case of coal with high moisture content.

A further problem lies in ensuring that the crushing effect and with it the nature of the product remains constant within narrow limits over a wide range of variation of the throughput.

The object of the invention, therefore, is to provide apparatus and methods of the type referred to for crushing of materials of all types, and in particular also with material which tends to slip on the rolls, whereby satisfactory drawing in of the material into the roll gap is ensured and a constant crushing effect (product granulation) is achieved irrespective of the nature of the product with a throughput which varies over a wide range.

SUMMARY OF THE INVENTION

According to the invention the material to be comminuted is forcibly delivered to the roll gap in a regulable mass flow, thereby avoiding the problems described above even in the case of materials which are difficult to draw in. At the same time the forcible delivery of the material to be comminuted in a regulable mass flow creates the possibility of keeping the crushing effect and with it the nature of the product constant within narrow limits over a wide range of variation of the throughput by altering the peripheral speed of the rolls proportionally to the forcibly delivered mass flow and at the same time keeping the crushing force constant in order to alter the throughput with a constant crushing effect.

The method according to the invention is suitable for the crushing of material of all types. It has particular advantages for the crushing of material which has a high moisture content and is simultaneously mechanically freed of water and crushed on passing through the roll gap. The material can be subjected to a precompression during the forcible delivery to the roll gap, for example by means of a screw conveyor.

Advantageous embodiments of the invention are explained in greater detail in connection with the following description of an embodiment which is illustrated in the drawings.

THE DRAWINGS

FIG. 1 shows a schematic cross-section through a material bed roll mill with a screw conveyor arranged before it, FIG. 2 shows a longitudinal section through a roll along the line II—II in FIG. 1.

DETAILED DESCRIPTION

Figure 1:
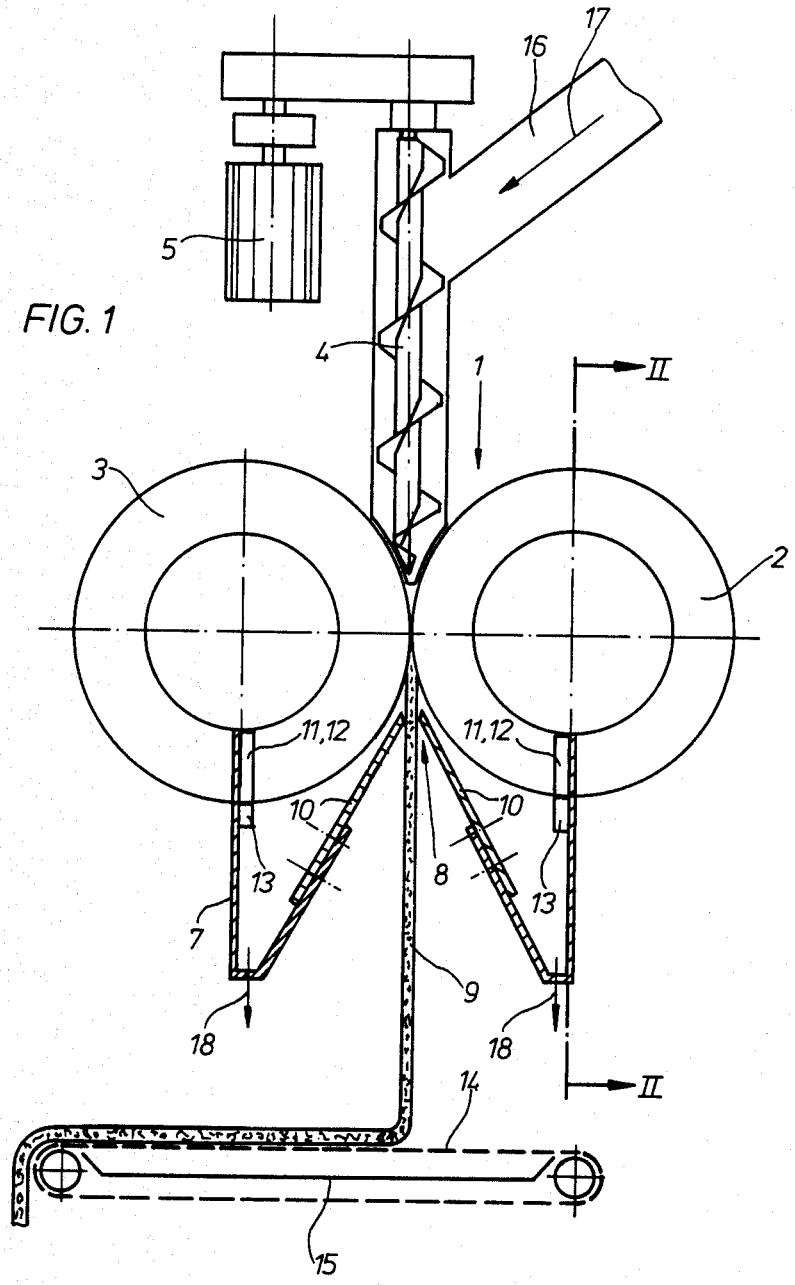
Figure 2:
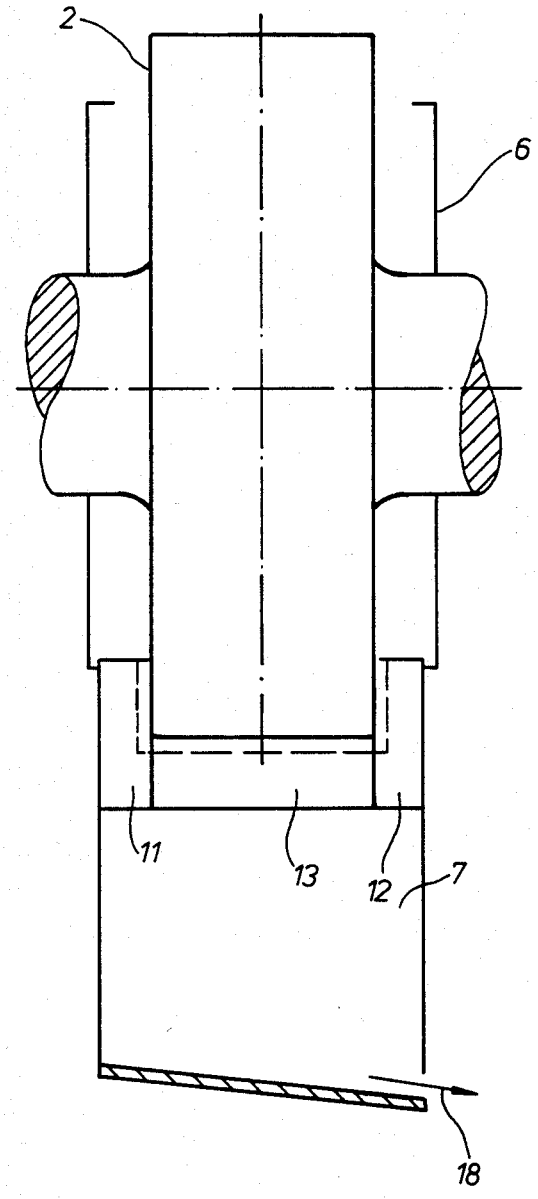

The illustrated apparatus contains a material bed roll mill 1 with two rotary rolls 2, 3 which are pressed against one another at high pressure. The roll 2 is for example constructed as a fixed roll whilst the roll 3, which is movable in the horizontal direction, is pressed in the direction of the fixed roll 2 by known actuating means which is not illustrated (for example a number of pressure cylinders).

One or more vertically arranged material feed screws 4 which are driven by a variable speed motor 5 so that the speed can be controlled are provided for the forcible delivery of a regulable mass flow of material to be comminuted to the roll gap.

The two rolls 2, 3 are enclosed by a housing 6 which is closed off at the bottom by a water collecting tank 7. This water collecting tank 7 has in the centre, below the roll gap, an opening 8 for the discharge of the stream of particles 9 leaving the roll gap downwards.

The opening 8 is defined by movable blades 10.

Wiping strips 11, 12, 13 are also provided at the end faces and at the periphery of the rolls 2, 3 in order to wipe off water adhering to the rolls 2, 3.

A conveyor device 14 which is constructed as a continuously moving screen, is permeable to fluids and picks up the stream of particles 9 is located below the material bed roll mill 1. A water collecting trough 15 which is inclined to one side (at right angles to the drawing plane of FIG. 1) is provided below the upper section of the conveyor device 14.

The material to be comminuted (arrow 17) passes via a chute 16 to the feed screw 4 and is forcibly delivered by the screw 4 to the roll gap in a regulable mass flow. The material to be comminuted undergoes a certain precompression in the region of the screw 4.

The material to be comminuted is crushed when it passes through the roll gap, and as a general rule it first undergoes individual grain crushing and then (in the same transit) material bed crushing. At the same time the material to be comminuted is mechanically freed of water on passing through the roll gap since the water, the volume of which exceeds the residual pore content of the particles, is driven out in the roll gap.

If the material to be comminuted has for example a residual porosity of 20% and a material density (dry) of 2.5 g/cm$^3$ then the volumetric residual water content is 20% and the water content relative to mass is 9%. Therefore the material to be comminuted can be freed of water or dried in the roll gap to approximately 9% residual moisture.

The water is essentially pushed towards the sides and, viewed in the direction of flow, back. The moisture content of the incoming material is raised by the water which is pushed back. A quasi-stationary state is then produced in which the "increase in moisture content" of the incoming material remains constant and streams of water or slurry escaping laterally are balanced with the difference in the moisture content of the material before and after the mill.

The streams of water or slurry escaping laterally are separated from the stream of particles by the blades 10 which are arranged immediately below the roll gap in order to prevent remoistening of the particles. The water adhering to the rolls 2, 3 is removed by the wiping strips 11, 12, 13 and led off out of the water collecting tank 7 (arrow 18) together with the water removed by the blades 10.

The conveyor device 14 which is constructed as a screen serves to allow fluid located on the exterior of the stream of particles to drip off.

The screw 4 serves on the one hand for the purpose of forcibly delivering the material to be comminuted, which at high roll speeds would slip or be unsatisfactorily drawn into the roll gap, to the roll gap and thus really for the first time facilitates a high throughput even with such material (for example very moist coal). The screw 4 also, however, serves the particular purpose of ensuring over a wide range of variations of the throughput that the crushing effect and with it the nature of the product remain constant within narrow limits.

For this purpose an arrangement (which is not illustrated) is provided which in the case of a desired alteration in the throughput alters the speed of the roll mill and the speed of the screw simultaneously in such a way that the peripheral speed of the rolls alters or varies in proportion to the mass flow forcibly delivered by the screw. If at the same time the crushing force (i.e. the force with which the movable roll 3 is pressed in the direction of the stationary roll 2) is kept constant, then the particle thickness and the crushing conditions and thus also the nature of the product remain constant.

This will be explained with the aid of the following formulae, in which the following abbreviations are used:

$\dot{M}$=throughput (mass flow)

D=roll diameter

L=roll gap length u=peripheral speed of rolls s=particle thickness (roll gap width)

$\rho$=particle density $\dot{m}$=specific throughput

The throughput (mass flow) $\dot{M}$ is given by the following equation:

$$\dot{M}=s\cdot L\cdot\mu\cdot\rho \quad (1)$$

If the specific throughput m is defined as follows:

$$\dot{m}=\frac{\dot{M}}{D\cdot L\cdot u} \quad (2)$$

then the following equation can be derived from equations (1) and (2):

$$s=\frac{D\cdot\dot{m}}{\rho} \quad (3)$$

If the roll speed is altered in order to adapt the mill throughput to the particular requirements, then according to the invention the speed of the screw 4 is altered so that the mass flow $\dot{M}$ which is forcibly delivered by the screw varies proportionally to the peripheral speed u of the rolls. Thus the specific throughput m remains constant, as follows from (2). However, the particle thickness s also remains unchanged, cf. (3).

If at the same time the crushing force is kept constant, then the crushing conditions in the roll gap and thus also the nature of the product remain unchanged.

For the sake of understanding it should also be noted that the ratio of crushing force to specific throughput is a characteristic quantity which has to be kept constant for the particular material and is a measurement for the energy requirement for the desired degree of crushing.

Thus the combined regulation of the screw and roll speeds ensures that the properties of the product can be kept constant and regulable, even when the properties of the material, such as grain size upon delivery, hardness, crushability, composition, moisture content etc., vary.

We claim:

1. Apparatus for simultaneously removing water from and crushing material having a high moisture content by passage between two rolls which are urged together under high pressure, said apparatus comprising screw conveyor means for simultaneously subjecting said material to mechanical precompression and forcible direct delivery between the two rolls, the fluid flow from said moisture removal being forced to the sides of said rollers and backward of the direction of material movement during crushing; means for separating the fluid pressed out of said material during crushing from the crushed material emerging from between the two rolls as a stream of particles immediately below the rolls to prevent remoistening of the particles, said separating means including blade means for separating fluid from the emerging crushed material; and wiping strips cooperating with the end and peripheral faces of said rolls for separating fluid pressed out of said material and carried along by said rolls during their rotation, said separating means including water collection and passage means for conducting the separated fluid away from said rolls.

2. Apparatus according to claim 1 including a moisture permeable conveyor for receiving said crushed material.

3. Apparatus according to claim 2 wherein said conveyor moves continuously transversely of the path of movement of said emerging material below said rolls, and including fluid collection means inclined below the upper surface of said conveyor to direct collected fluid from the material carried by said conveyor.

4. Apparatus according to claim 1 including means urging said rolls together under a constant force, and control means for driving at least one of said rolls and said screw conveyor means simultaneously to maintain the peripheral speed of said rolls proportional to the flow of material delivered by said screw conveyor between said rolls, whereby the crushing conditions and nature of the delivered material are maintained aubstantially constant.

* * * * *

UNITED STATES PATENT AND TRADEMARK OFFICE

CERTIFICATE OF CORRECTION

PATENT NO. : 4,709,864

DATED : December 1, 1987

INVENTOR(S) : Heinrich Henne et al

It is certified that error appears in the above-identified patent and that said Letters Patent is hereby corrected as shown below:

Column 3, line 61, change "m" to -- $\dot{m}$ -- .

Column 4, line 10, change "m" to -- $\dot{m}$ -- .

Signed and Sealed this

Thirty-first Day of May, 1988

*Attest:*

*Attesting Officer*

DONALD J. QUIGG

*Commissioner of Patents and Trademarks*